US007124550B1

(12) United States Patent
Deming

(10) Patent No.: US 7,124,550 B1
(45) Date of Patent: Oct. 24, 2006

(54) ANCHORING FRAMEWORK TO A MASONRY WALL

(76) Inventor: Richard Allen Deming, 3415 Lake Buffum Rd. East, Fort Meade, FL (US) 33841

( * ) Notice: Subject to any disclaimer, the term of this patent is extended or adjusted under 35 U.S.C. 154(b) by 281 days.

(21) Appl. No.: 10/824,530

(22) Filed: Apr. 14, 2004

(51) Int. Cl.
*E04C 5/12* (2006.01)
*E04B 1/00* (2006.01)
*E04G 21/00* (2006.01)

(52) U.S. Cl. ..... 52/745.21; 52/745.19; 52/745.21; 52/295; 52/699; 52/127.2; 52/322; 52/703; 52/745.09

(58) Field of Classification Search ..... 52/292–299, 52/404.1–404.5, 319–341, 698–703, 127.1, 52/127.2, 561–568, 378–379, 322, 344, 351, 52/353, 746.1, 747.1, 745.17, 742.1, 742.12, 52/742.13, 742.14, 742.15, 742.16, 745.05, 52/745.09, 745.1, 745.16, 745.18, 745.19, 52/745.21; 249/40, 83, 91, 93–94, 207, 210
See application file for complete search history.

(56) References Cited

U.S. PATENT DOCUMENTS

| | | | | | |
|---|---|---|---|---|---|
| 1,199,077 | A * | 9/1916 | James | 249/210 |
| 1,816,226 | A * | 7/1931 | Krabiel | 52/370 |
| 4,167,840 | A * | 9/1979 | Ivany | 52/438 |
| 4,412,407 | A * | 11/1983 | Melfi et al. | 52/699 |
| 4,566,238 | A * | 1/1986 | Janopaul, Jr. | 52/404.3 |
| 4,726,567 | A * | 2/1988 | Greenberg | 256/19 |
| 4,736,554 | A * | 4/1988 | Tyler | 52/105 |
| 5,060,436 | A * | 10/1991 | Delgado, Jr. | 52/295 |
| 5,240,224 | A * | 8/1993 | Adams | 249/93 |
| 5,240,240 | A * | 8/1993 | Magee et al. | 271/20 |
| 5,335,470 | A * | 8/1994 | Alvarez | 52/699 |
| 5,337,534 | A * | 8/1994 | Nasca | 52/745.21 |
| 5,575,593 | A * | 11/1996 | Raaf | 405/237 |
| 5,586,417 | A * | 12/1996 | Henderson et al. | 52/295 |
| 5,836,132 | A * | 11/1998 | Weathersby | 52/702 |
| 5,937,609 | A * | 8/1999 | Roth | 52/698 |
| 6,098,357 | A * | 8/2000 | Franklin et al. | 52/223.7 |
| 6,105,332 | A * | 8/2000 | Boyadjian | 52/698 |
| 6,120,723 | A * | 9/2000 | Butler | 264/333 |
| 6,161,339 | A | 12/2000 | Cornett et al. | |
| 6,378,269 | B1 * | 4/2002 | Wiegand, Sr. | 52/745.05 |
| 6,431,517 | B1 * | 8/2002 | Chapman | 249/93 |
| 6,571,526 | B1 | 6/2003 | Queen | |
| 6,591,562 | B1 * | 7/2003 | Ting | 52/235 |
| 6,735,913 | B1 * | 5/2004 | Sanders et al. | 52/284 |
| 2003/0025047 | A1 * | 2/2003 | Kilkenny | 248/65 |

* cited by examiner

*Primary Examiner*—Jeanette Chapman
(74) *Attorney, Agent, or Firm*—David Kiewit

(57) ABSTRACT

An upper framed portion of a building structure may be anchored to a lower masonry wall by using a conventional concrete anchor and an anchor retainer. The anchor retainer may have a body portion longer than the width of the wall and both upper and lower reference surfaces. An anchor retainer assembly is temporarily formed by inserting the anchor through a throughhole in the retainer body so that the threaded upper portion of the anchor extends above the upper reference surface of the retainer by a first selected height, so as to leave enough of the threaded end exposed above the retainer for at least one nut to be securely attached to the anchor. No unthreaded portion of the anchor extends above the lower reference surface by more than a second amount that is generally selected to be equal to the actual thickness of the framing member, so as to ensure that no substantial unthreaded portion of the anchor can extend above that member.

2 Claims, 3 Drawing Sheets

FIG. 3
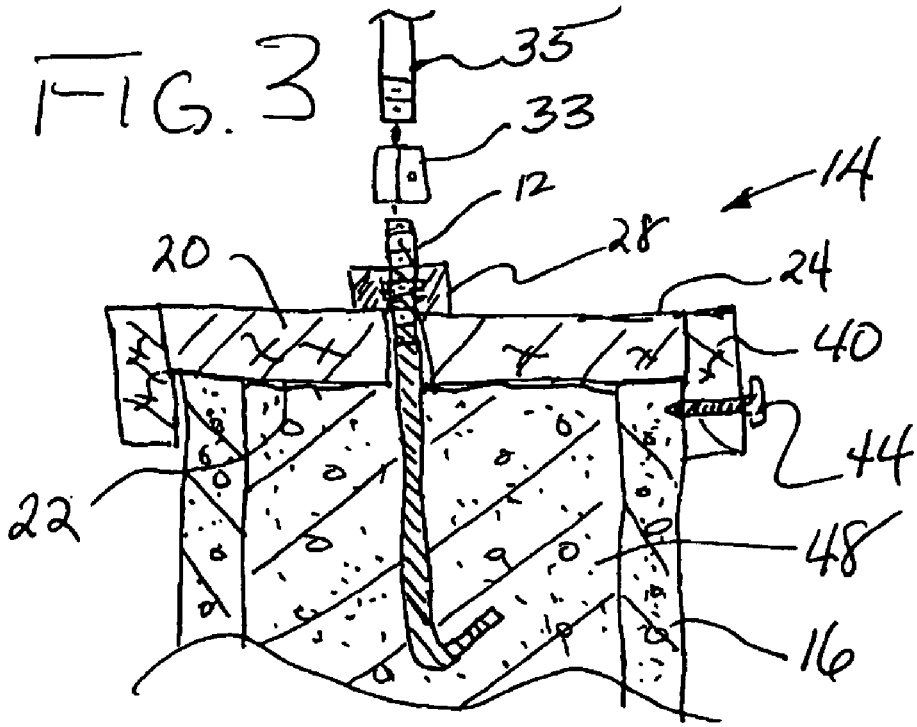
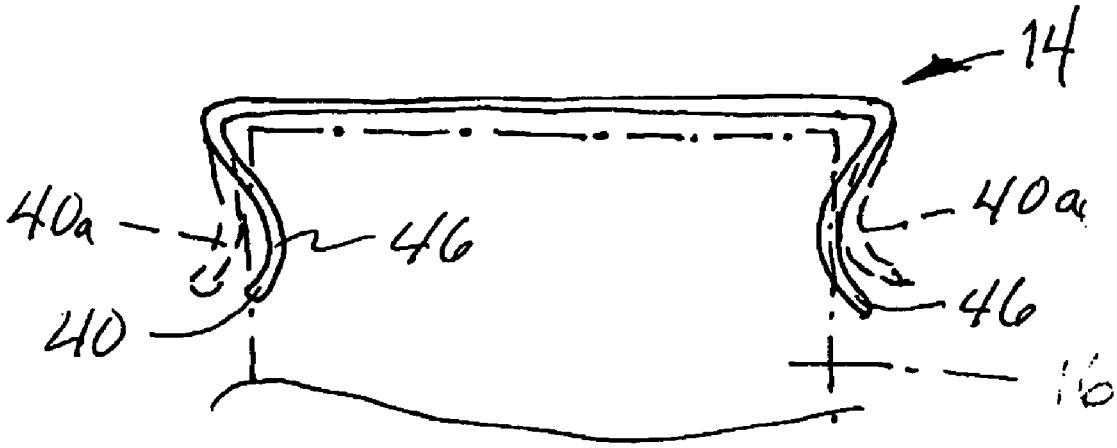
FIG. 4

ANCHORING FRAMEWORK TO A MASONRY WALL

BACKGROUND OF THE INVENTION

1. Field of the Invention

The invention relates to a tie or anchoring arrangement assembled in situ to anchor an upper framed portion of a building structure to a lower masonry wall portion 2. Background Information Concrete masonry walls can be formed of vertically stacked concrete blocks having internal, vertical, mutually aligned cavities that form channels extending vertically through the wall. These may be reinforced by placing rebar through the vertically aligned cavities and filling the channels about the bars with a wet cementitious mixture known as grout. The grout, when set, locks the bars to the blocks and thus provides the wall with increased resistance to applied loads.

Frame structures are often erected on top of reinforced or non-reinforced masonry walls. These may be roofs, wooden frame portions of composite walls, or a combination of a framed upper wall and a roof. Composite walls having a framed upper portion are popular in the construction of multi-story, multi-family residential buildings. The upper frame portion of the overall structure may be constructed in situ at the job site, may be prefabricated off site, or may be assembled on-site from prefabricated components (e.g., the combination of a prefabricated wall and a roof formed from prefabricated trusses). Regardless of the exact nature of its construction, the frame portion of such a structure is preferably firmly connected to the underlying masonry wall. In many locales, where hurricanes and other windstorms are a concern, building codes mandate that framework above a masonry wall be tied to the underlying wall by means suitable to withstand a substantial vertical force, as is expected from hurricane force winds.

One method for anchoring structural framework to the top of a masonry wall involves embedding anchors having threaded upper end portions into grout filling the vertical channels. Each of these anchors is preferably emplaced so that its shank and threaded upper end portions are vertical. Moreover, the anchors are set at pre-selected positions along the wall that accord with mating holes drilled through or otherwise formed in a sill plate or other lowermost portion of the framework. An initial step in erecting the framework may then consist of placing the lowermost piece of a wall frame over the protruding anchors, placing suitable washers and nuts on the threaded shafts of the anchors and turning the nuts to attach those two portions of the composite structure together.

This method relies on anchors being reliably emplaced in vertical settings at pre-selected positions along the wall. If an anchor is tilted or displaced from its predetermined position, erection of the framework will be delayed until that anchor is cut off and possibly replaced. Unfortunately, the prior art does not provide a reliable means for emplacing an entire array of anchors along a wall. If anchors are emplaced by being manually inserted into wet, unset grout, some of those anchors may fall over into unacceptable orientations as the grout sets. If anchors are vertically suspended from wire hangers prior to pouring the grout, some fraction of the anchors are often accidentally moved from their desired locations during grouting.

Queen, in U.S. Pat. No. 6,571,526, teaches apparatus for setting a reinforcing rod at a preselected position within a vertical channel in a concrete masonry wall. His devices generally provide a vertically extensive support for the rod at the top of a channel. Queen's devices, however, all extend downward an appreciable distance from the top of a block into the vertical channel. While this may be acceptable for setting the position and vertical orientation of a long rebar that extends the full height of the wall, it is unacceptable for embedding relatively short anchors at the top of the wall. Because his plastic device remains in the grout, Queen's approach would seriously degrade a short anchor's ability to withstand the vertical hold-down force specified by building codes.

BRIEF SUMMARY OF THE INVENTION

A preferred embodiment of the invention provides a method for connecting structural framework atop a concrete masonry wall that may be made up of several tows of blocks, each of which has at least one vertically disposed channel extending all the way through it. As is conventional in the art, a width of the masonry wall is the same as the predetermined width of each of the blocks. As is also conventional, the framework may comprise a sill plate portion made from a piece of lumber having a standard thickness. A preferred method of connecting the masonry wall to the framework involves using an anchor and an anchor retainer. The anchor is conventionally made from a steel rod having a threaded upper end and a lower grout-engaging end that extends laterally outward from the axis of the rod by more than the radius of the rod. The preferred anchor retainer comprises a body portion that is longer than the width of the wall and that has both upper and lower reference surfaces. In addition, the preferred anchor retainer has two legs attached to the body at respective points adjacent the two ends of that body. When the retainer is in use and is operatively emplaced atop a wall, these two legs extend downward on either side of that wall.

In practicing the preferred method, an anchor retainer assembly is temporarily formed by inserting the anchor through a throughhole in the retainer body so that the threaded upper portion of the anchor extends above the upper reference surface of the retainer by a first selected height, so as to leave enough of the threaded end exposed above the retainer for at least one nut to be securely attached to the anchor. Moreover, in this method no unthreaded portion of the anchor extends above the lower reference surface by more than a second amount that is generally selected to be equal to the actual thickness of the framing member, so as to ensure that no substantial unthreaded portion of the anchor can extend above the sill plate. As discussed at greater length hereinafter, when the anchor is to be used with a top plate and roof tie-down arrangement, such as the one taught by Cornett et al. in U.S. Pat. No. 6,161,339, the disclosure of which is incorporated herein by reference, the first selected height of the anchor retainer is selected so as to leave enough of the threaded end of the anchor extending above the sill plate to engage both a sill plate attaching nut and a connecting nut that connects additional portions of the tie-down apparatus to the anchor.

In continuing with the preferred method, the temporary anchor retainer assembly is placed on the masonry wall so that the top surface of the wall abuts the bottom reference surface of the retainer, so that the lower end of the anchor hangs down into the vertical channel, and so that no portion of the retainer extends downward into the channel below the top of the wall. The channel is then filled with grout, which is allowed to harden so as to capture the lower end of the anchor. The temporary anchor retainer assembly is then disassembled by removing the anchor retainer from the anchor so as to leave the threaded upper end of the anchor sticking up above the wall. Framework, which may comprise a portion of an upper story wall, is then placed on the top of the wall so that the threaded end of the anchor extends upward through a pre-drilled throughhole in the bottom of the frame. The frame is then fastened to the wall by any of a variety of methods, which may comprise simply threading a nut onto the anchor so as to capture the lowest member of the frame, but which is likely to also involve attaching an additional elongated anchoring member to it in order to hold down the top plate and roof trusses, as taught by Cornett et al.

Although the method described above can be used to provide a plurality of vertically disposed anchors at selected points along a wall for anchoring a framing member to the wall in order to resist an upward force, preferred embodiments of the method also provide means of assuring that the anchor retainer assembly is not accidentally moved laterally or tilted with respect to the vertical during the grouting operation. Thus, a preferred anchor retainer of the invention comprises a body that is not only longer than the width of the wall with which it is to be used, but that is also wide enough to resist twisting forces if the anchor retainer assembly is attached to the wall. Preferred approaches for temporarily attaching the anchor retainer assembly to the wall during the grouting operation comprise nailing the retainer to the wall by means of a throughhole provided in at least one of the retainer legs and, alternately, providing flexible, springy legs that are pulled apart to fit the retainer over the wall and that, when released, clamp the retainer assembly to the wall. Both of these methods of temporarily attaching the retainer to the wall depend on the dimensions of the retainer being selected to accord with whatever standard block width is used.

Although it is believed that the foregoing rather broad recital of features and technical advantages may be of use to one who is skilled in the art and who wishes to learn how to practice the invention, it will be recognized that the foregoing recital is not intended to list all of the features and advantages. Those skilled in the art will appreciate that they may readily use both the underlying ideas and the specific embodiments disclosed herein as a basis for designing other arrangements for carrying out the same purposes of the present invention. Those skilled in the art will realize that such equivalent constructions are within the spirit and scope of the invention in its broadest form. Moreover, it may be noted that various embodiments of the invention may provide various combinations of the hereinbefore recited features and advantages of the invention, and that less than all of the recited features and advantages may be provided by some embodiments.

BRIEF DESCRIPTION OF THE SEVERAL VIEWS OF THE DRAWING

FIG. 3 is a partly sectional, partly exploded view of a second embodiment of an anchor retainer used with a tie-down system, the section taken through a block as indicated by the double-headed arrow in FIG. 1.

FIG. 4 is an side elevational view of a preferred anchor retainer of the invention showing a spring biased clamping action.

DETAILED DESCRIPTION OF THE INVENTION

In studying this Detailed Description, the reader may be aided by noting definitions of certain words and phrases used throughout this patent document. Wherever those definitions are provided, those of ordinary skill in the art should understand that in many, if not most instances, such definitions apply to prior, as well as future uses of such defined words and phrases. At the outset of this Description, one may note that the terms "include" and "comprise," as well as derivatives thereof, mean inclusion without limitation; the term "or," is inclusive, meaning and/or. The term "framework" stands for any sort of structural framing using in building construction and comprises structural members made from lumber, steel, aluminum, or any other material or combination thereof; such framework may comprise prefabricated sub-assemblies brought to a job site, or may comprise a framework erected from individual pieces of lumber or other structural members at the job site. A lowest horizontally extensive member of such framework is referred to herein as a 'sill plate'. The term "anchor", as used herein, shall stand for a elongated structural element having an axis, the anchor comprising: a steel rod having a threaded portion on at least one of its two ends; and a grout-engaging portion adjacent the other end of the rod, the grout-engaging portion characterized in that it extends laterally beyond a diameter of the rod.

Figure 1:
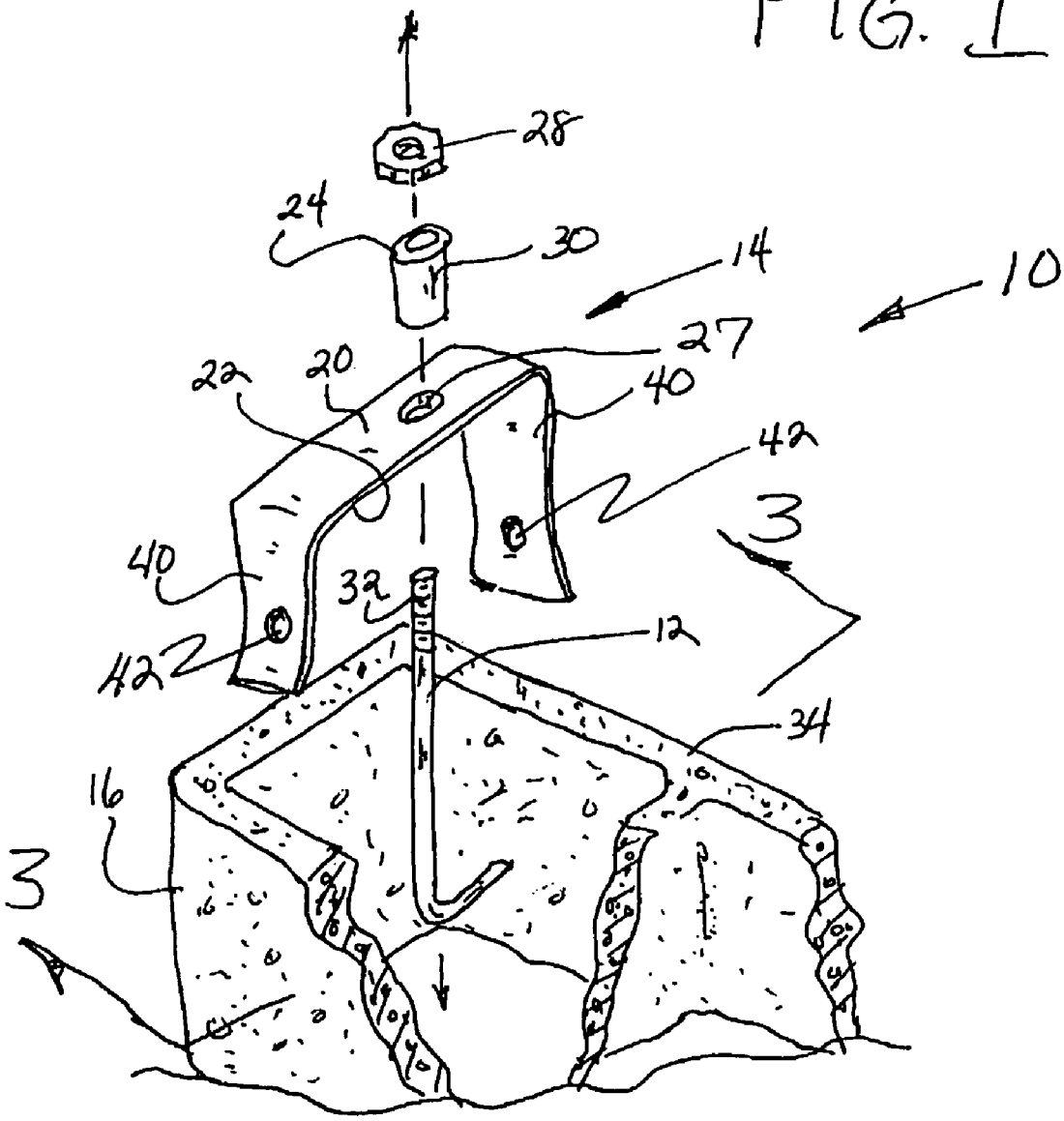
FIG. 1 is an exploded view of an assembly comprising an anchor, an anchor retainer and a concrete block.

Turning initially to FIG. 1, one finds an exploded view of a preferred retainer assembly 10, comprising a concrete anchor 12 and a retainer 14, used in conjunction with a concrete block 16 of the sort commonly used in construction of a concrete masonry wall 18. The depicted retainer 14 comprises a body portion 20 having a lower reference surface 22 long enough to extend completely across the block 16 with which it is to be used. The retainer 14 also provides an upper reference surface 24 that is, when the retainer is completely assembled, spaced apart from the lower reference surface by a selected distance that is preferably no greater than the thickness of a framing member 26 that is to be attached to the wall 18. Those skilled in the construction arts will appreciate that standard sizes for lumber, for steel framing members, and for blocks vary from place to place and may be changed at various times so that the sizes of the retainers of the invention will have to be adjusted accordingly. Moreover, those skilled in the construction arts will realize that many such framing members that are used in making walls in which the exterior surfaces of the upper and lower story portions are co-planar are narrower than is a conventional masonry block, hence, the retainer may be designed to offset the anchor 12 from a center line of the wall by selecting the position along the length of the body 20 at which the throughhole 27 is formed.

The preferred retainer depicted in FIG. 1 additionally comprises a nut 28 and a bushing 30. The bushing 30 need not be a separate element and may be glued, welded, or otherwise permanently attached to or integrally formed with the body. 20 of the retainer. Alternate embodiments of the retainer 14, as depicted in FIG. 3, provide a retainer body 20 having a uniform thickness equal to the selected spacing between the upper and lower reference surfaces.

Figure 2:
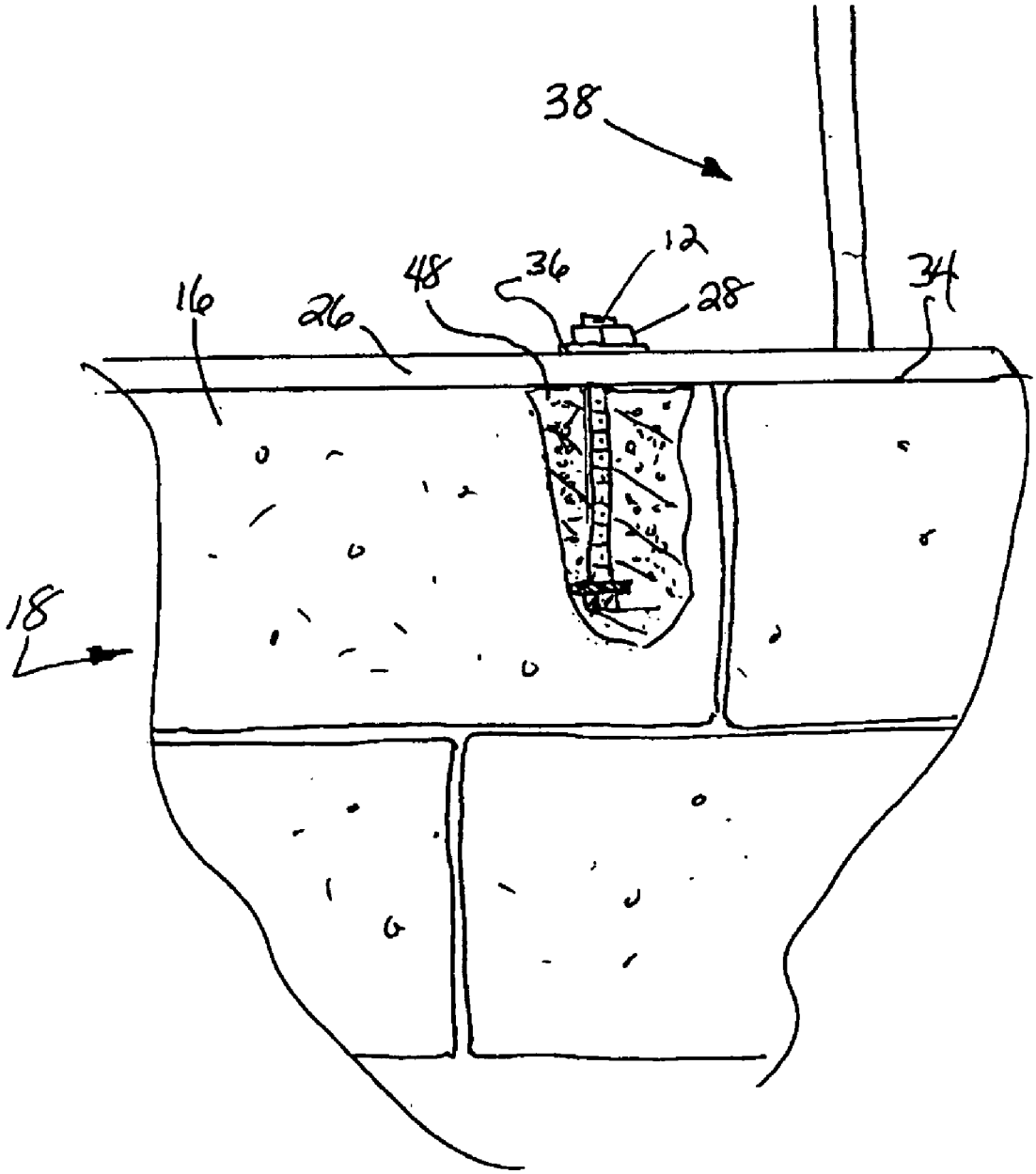
FIG. 2 is a partly cut away elevational view showing a framing member anchored to a masonry wall.

The matter of separating an upper and lower reference surface by a selected distance allows the preferred retainer to be used with anchors 12 having a threaded upper end and an un-threaded shank. Although it is known in the art to make a suitable anchor, such as that depicted in FIG. 2, from a fully threaded rod having a lower, concrete-engaging end formed by threading a nut and washer onto the lower end of the rod, it is generally preferably to use an anchor of the sort depicted in FIGS. 1 and 3, where the grout-engaging portion of the anchor is formed by bending a portion of the rod. Anchors of this sort have a threaded end 32 and an unthreaded shank. In using this sort of anchor with a retainer 14 of the invention, the dimensions of the various elements may be selected so that when a nut 28 is fully threaded onto the anchor 12 so that the nut reaches the bottom-most thread, the length of the anchor below the retainer 14 is adequate for resisting whatever vertical uplift force is specified. Moreover, because the upper and lower reference surfaces are preferably spaced apart from each other by no more than the thickness of the member to be used to make the sill plate or other framing member 26, only the threaded portion of the anchor shank can project upward above a top surface 34 of the masonry wall 18 far enough to engage the nut 28 and washer 36 that are subsequently employed to clamp the structural framework 38 to the wall 18. The threaded end portion 32 of the anchor 12 can, of course, have a length selected to extend well above the top of the sill plate and the sill plate nut 28 in order to allow the installation of a connecting nut 33 connecting the anchor 12 to a vertical rod 35 portion of a roof or top-plate tie-down system.

In a preferred method of the invention, some selected number of temporary anchor retainer assemblies 10 is provided after a wall 18 has been erected, but before that wall is grouted. Each of the retainers is placed at a selected position along the wall, where this position is selected to accord with one of the holes drilled through whatever framing member 26 is to be tied down by means of that anchor. Each retainer is fastened to the wall at its selected position by some means that ensures that the anchor 12 can be neither moved away from the selected position nor tilted away from a vertical orientation.

There are several approaches to ensuring that the anchor is not displaced during grouting. In many embodiments of the invention the anchor retainer comprises a body portion having a leg 40 depending from each of the two ends thereof, where each such leg has a throughhole 42 formed in it to allow a worker to use a suitable elongated concrete-penetrating fastener 44, such as a concrete nail or a concrete screw, to fasten the retainer 14 to a block 16 during the grouting operation. In some embodiments the legs 40 are flexible and springy and have portions 46 that are spaced apart from each other by less than the width of a block when the retainer is not attached to the block. A retainer of this sort can be temporarily attached to a block by placing it on the top of the block and pushing downward so as to force the legs 40*a* apart into the configuration shown in phantom in FIG. 4 in which the legs are biased by spring forces into clamping contact with the block.

Preferred anchor retainers 14 have a body 20 wide enough so that any forces, such as those that may arise from the grout 48 rising inhomogenously about the anchor during the grouting operation, can not twist the anchor away from a vertical orientation. This width is limited by the practical consideration that enough open space has to be available at the top of the channel in order for grout 48 to be added. Tests have shown that a retainer width of between one and two inches is satisfactory.

In a preferred method, the anchor retainer assemblies are attached to the wall as described above and grout 48 is added to fill the channels. After the grout 48 has been allowed to harden, the retainers 14 are removed, leaving a plurality of anchors embedded in the wall at locations selected to accord with throughholes in the framework 38. The framework 38 is then placed on the wall 18 and suitable fasteners, such as the conventional combination of a washer 36 and a nut 28, are used to attach the framework to each of the anchors. In practice, however, the anchoring system of the invention is also intended for use in more complex interconnections. For example, each of a plurality of anchors can be attached, by a respective connecting nut 33 to a respective vertical rod 35 portion of a tie-down system, such as that taught by Cornett et al. in U.S. Pat. No. 6,161,339.

Those skilled in the arts will appreciate that because the lower reference surface 22 of the retainer 14 extends all the way across the wall at the top of the channel, no portion of the retainer is embedded in the grout. In addition to facilitating removal of the retainer for its reuse, this also advantageously maximizes the strength of the anchoring arrangement against a vertical lifting force. If any portion of a retainer was allowed to penetrate into the channel, complete removal of the retainer would be difficult and would leave a void about the shank of the anchor. Leaving a void, or leaving a portion of the retainer embedded in the grout would reduce the anchor's ability to hold down the framework against a vertical uplift.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

The invention claimed is:

1. A method for connecting a framework comprising a lowest portion to a top of a concrete masonry wall comprising at least one vertical channel, the method comprising the steps of:

a) providing an anchor retainer assembly comprising an anchor connected to an anchor retainer wherein the anchor comprises a threaded upper end portion and a grout-engaging lower portion and the anchor retainer comprises a body having two flexible legs depending therefrom, at least portions of the flexible legs spaced apart by less than a thickness of the wall when the anchor retainer is not abutting the wall;

b) placing the anchor retainer assembly on the concrete masonry wall so that the two legs of the retainer depend downwards on respective sides of the wall and pushing the retainer assembly downward so that the legs are forced apart to clamp the retainer assembly to the wall by spring forces so that a selected portion of the anchor extends above the top of the wall and so that the grout-engaging end of the anchor depends into the vertical channel;

d) pouring grout into the vertical channel and allowing the grout to harden so as to capture the grout-engaging end of the anchor therewithin;

e) disconnecting the anchor retainer from the anchor and removing the retainer;

f) placing a lowest portion of the framework on top of the wall so that the threaded upper end of the anchor extends upward through a throughhole in the lowest portion of the framework; and g) threading at least one nut onto the anchor to fasten the framework to the masonry wall.

2. The method of claim 1 further comprising an additional step carried out subsequent to placing the retainer assembly on the wall and prior to pouring the grout into the vertical channel, the additional step comprising attaching at least one of the legs of the retainer to the wall by means of a concrete-penetrating fastener.

* * * * *